US011302260B2

(12) United States Patent
Chung

(10) Patent No.: US 11,302,260 B2
(45) Date of Patent: Apr. 12, 2022

(54) SIGNAL PROCESSING CIRCUIT AND DRIVING METHOD THEREOF, DISPLAY PANEL AND DRIVING METHOD THEREOF AND DISPLAY DEVICE

(71) Applicants: MIANYANG BOE OPTOELECTRONICS TECHNOLOGY CO., LTD., Sichuan (CN); BOE TECHNOLOGY GROUP CO., LTD., Beijing (CN)

(72) Inventor: Chieh Hsing Chung, Beijing (CN)

(73) Assignees: MIANYANG BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 348 days.

(21) Appl. No.: 16/470,659

(22) PCT Filed: Nov. 13, 2018

(86) PCT No.: PCT/CN2018/115253
§ 371 (c)(1),
(2) Date: Jun. 18, 2019

(87) PCT Pub. No.: WO2019/200901
PCT Pub. Date: Oct. 24, 2019

(65) Prior Publication Data

US 2021/0335272 A1 Oct. 28, 2021

(30) Foreign Application Priority Data

Apr. 16, 2018 (CN) ..... 201810338993.1

(51) Int. Cl.
*G09G 3/3275* (2016.01)
*G09G 3/3266* (2016.01)

(52) U.S. Cl.
CPC ..... *G09G 3/3275* (2013.01); *G09G 3/3266* (2013.01); *G09G 2310/0291* (2013.01)

(58) Field of Classification Search
CPC ..... G09G 2310/027; G09G 2310/0297; G09G 3/3688; G09G 3/2011; G09G 3/3614;
(Continued)

(56) References Cited

U.S. PATENT DOCUMENTS

2003/0071778 A1 4/2003 Lee et al.
2003/0071779 A1 4/2003 Lee et al.
(Continued)

FOREIGN PATENT DOCUMENTS

CN 1412736 A 4/2003
CN 1413737 A 4/2003
(Continued)

OTHER PUBLICATIONS

First Chinese Office Action dated May 7, 2020; Application No. 201810338993.1.
(Continued)

*Primary Examiner* — Koosha Sharifi-Tafreshi

(57) ABSTRACT

A signal processing circuit and a driving method thereof, a display panel and a driving method thereof, and a display device are disclosed. The signal processing circuit includes a shunting circuit and N buffer circuits. The shunting circuit includes N output nodes, the N buffer circuits are respectively connected with the N output nodes. The shunting circuit is configured to output input signals to the N output nodes respectively at N different time points in response to control signals. Each of the N buffer circuits is configured to buffer and output the input signal received by a corresponding output node. N is an integer great than or equal to 2.

18 Claims, 10 Drawing Sheets

(58) Field of Classification Search
CPC ..... G09G 2320/0276; G09G 3/20; G09G 3/3266; G09G 3/36; G09G 2310/0291; G09G 3/3275; G09G 3/3283; G09G 3/3291; G09G 2310/0275; G09G 2310/0272; G09G 3/3685
See application file for complete search history.

(56) References Cited

U.S. PATENT DOCUMENTS

| | | | | |
|---|---|---|---|---|
| 2003/0132907 | A1 | 7/2003 | Lee et al. | |
| 2005/0100057 | A1 | 5/2005 | Shin | |
| 2006/0001618 | A1 | 1/2006 | Shin | |
| 2006/0055656 | A1* | 3/2006 | Chung | G09G 3/3688 345/100 |
| 2007/0035506 | A1* | 2/2007 | Lee | G09G 3/3688 345/100 |
| 2009/0225104 | A1 | 9/2009 | Hu et al. | |
| 2015/0155880 | A1 | 6/2015 | Tu et al. | |
| 2016/0372028 | A1 | 12/2016 | Park | |
| 2019/0244569 | A1 | 8/2019 | Sun et al. | |

FOREIGN PATENT DOCUMENTS

| | | | |
|---|---|---|---|
| CN | 1432989 | A | 7/2003 |
| CN | 1447302 | A | 10/2003 |
| CN | 1766974 | A | 5/2006 |
| CN | 1987990 | A | 6/2007 |
| CN | 104008721 | A | 8/2014 |
| CN | 105469765 | A | 4/2016 |
| CN | 106257580 | A | 12/2016 |
| CN | 106504698 | A | 3/2017 |
| CN | 109427292 | A | 3/2019 |
| EP | 0275140 | A2 | 7/1988 |
| KR | 2018000797 | A | 1/2018 |

OTHER PUBLICATIONS

International Search Report and Written Opinion dated Jan. 30, 2019; PCT/CN2018/115253.
The extended European search report dated Dec. 10, 2021; Appln. No. 18887201.4.

* cited by examiner

SIGNAL PROCESSING CIRCUIT AND DRIVING METHOD THEREOF, DISPLAY PANEL AND DRIVING METHOD THEREOF AND DISPLAY DEVICE

The present application claims priority to Chinese patent application No. 201810338993.1 filed on Apr. 16, 2018, the entire disclosure of which is incorporated herein by reference as part of the present application.

TECHNICAL FIELD

Embodiments of the present disclosure relate to a signal processing circuit and a driving method thereof, a display panel and a driving method thereof and a display device.

BACKGROUND

With the development of display technologies, various display screens have been widely applied. These display screens can provide rich and colorful pictures and good visual experience for users. Display screens mainly include liquid crystal display (LCD) screens and organic light-emitting diode (OLED) display screens, and can be applied in electronic devices with display function, such as mobile phones, TV sets, laptops, digital cameras, instrumentation, virtual reality (VR) devices, augmented reality (AR) devices.

SUMMARY

At least an embodiment of the present disclosure provides a signal processing circuit. The signal processing circuit comprises a shunting circuit and N buffer circuits; the shunting circuit comprises N output nodes; the N buffer circuits are respectively connected with the N output nodes; the shunting circuit is configured to output input signals to the N output nodes respectively at N different time points in response to control signals; each of the N buffer circuits is configured to buffer an input signal received by a corresponding output node; and N is an integer that is greater than or equal to 2.

For example, in the signal processing circuit provided by an embodiment of the present disclosure, a first terminal of the each of the N buffer circuits is configured to be connected with the corresponding output node to the each of the N buffer circuits; and a second terminal of the each of the N buffer circuits is configured to be connected with a first voltage terminal, so as to receive a first voltage.

For example, in the signal processing circuit provided by an embodiment of the present disclosure, the each of the N buffer circuits comprises a capacitor, a first electrode of the capacitor serves as the first terminal of the each of the N buffer circuits, and a second electrode of the capacitor serves as the second terminal of the each of the N buffer circuits.

For example, in the signal processing circuit provided by an embodiment of the present disclosure, the signal processing circuit further comprises N reset circuits, and the N reset circuits are respectively connected with the N output nodes and are configured to reset the N output nodes in response to a reset signal.

For example, in the signal processing circuit provided by an embodiment of the present disclosure, a control terminal of each of the N reset circuits is configured to be connected with a reset signal line so as to receive the reset signal, a first terminal of the each of the N reset circuits is configured to be connected with a corresponding output node, and a second terminal of the each of the N reset circuits is configured to be connected with a second voltage terminal so as to receive a second voltage.

For example, in the signal processing circuit provided by an embodiment of the present disclosure, the each of the N reset circuits comprises a reset transistor, a gate electrode of the reset transistor serves as the control terminal of the each of the N reset circuits, a first terminal of the reset transistor serves as the first terminal of the each of the N reset circuits, and a second terminal of the reset transistor serves as the second terminal of the each of the N reset circuits.

For example, in the signal processing circuit provided by an embodiment of the present disclosure, the shunting circuit further comprises an input terminal, N input control terminals and N switching circuits; the N switching circuits are connected with the input terminal, respectively connected with the N output nodes in one-to-one correspondence, and respectively connected with the N input control terminals in one-to-one correspondence; each of the N switching circuits is configured to output an input signal received from the input terminal to a corresponding output node in response to a control signal received from a corresponding input control terminal.

For example, in the signal processing circuit provided by an embodiment of the present disclosure, the each of the N switching circuits comprises a switching transistor, a gate electrode of the switching transistor is connected with the corresponding input control terminal, a first terminal of the switching transistor is connected with the input terminal, and a second terminal of the switching transistor is connected with the corresponding output node.

For example, in the signal processing circuit provided by an embodiment of the present disclosure, N is equal to 2, and the N input control terminals are connected with each other, so as to be connected with same one input control line.

For example, in the signal processing circuit provided by an embodiment of the present disclosure, the N switching circuits comprises a first switching circuit and a second switching circuit; the shunting circuit further comprises an invert circuit; and one of the first switching circuit and the second switching circuit is connected with the N input control terminals through the invert circuit.

At least an embodiment of the present disclosure provides a display panel, which comprises the signal processing circuit provided by any embodiment of the present disclosure and comprises a plurality of data lines. N data lines of the plurality of data lines are respectively connected with the N buffer circuits of the signal processing circuit, and the input signals are display data signals.

For example, the display panel provided by an embodiment of the present disclosure further comprises a plurality of pixel units which are arranged in an array. The N data lines which are connected to the signal processing circuit are connected with same one column of pixel units; the same one column of pixel units comprises N pixel unit groups; and each of the N pixel unit groups is connected with same one data line.

For example, in the display panel provided by an embodiment of the present disclosure, N is equal to 2; the N pixel unit groups comprise a first pixel unit group and a second pixel unit group; the first pixel unit group comprises pixel units at odd numbered rows, and the second pixel unit group comprises pixel units at even numbered rows.

For example, the display panel provided by an embodiment of the present disclosure further comprises an array substrate. The signal processing circuit is on the array substrate.

For example, in the display panel provided by an embodiment of the present disclosure, the N data lines which are connected to same one signal processing circuit are at different layers of the array substrate.

For example, the display panel provided by an embodiment of the present disclosure further comprises at least one gate driving circuit. The gate driving circuit is configured to provide a plurality of gate scanning signals, so as to scan the pixel units of the display panel; and a pulse duration of a gate scanning signal for (M+1)th row partially overlaps a pulse duration of a gate scanning signal for (M)th row, and M is an integer greater than 0.

At least an embodiment of the present disclosure provides a display device, which comprises the display panel provided by any embodiment of the present disclosure or the signal processing circuit provided by any embodiment of the present disclosure.

At least an embodiment of the present disclosure provides a driving method of the signal processing circuit provided by any embodiment of the present disclosure, which comprises: providing the control signals and the input signals; allowing the shunting circuit to sequentially output the input signals to the N output nodes respectively at N different time points in response to the control signals; and buffering and outputting one of the input signals through the each of the N buffer circuits.

At least an embodiment of the present disclosure provides a driving method of the display panel provided by any embodiment of the present disclosure, which comprises: providing the control signals and the display data signals; allowing the shunting circuit to sequentially output the display data signals to the N output nodes respectively at the N different time points in response to the control signals; and buffering and outputting the display data signals to N corresponding data lines through the N buffer circuits.

For example, the driving method provided by an embodiment of the present disclosure further comprises: providing gate scanning signals, so as to perform row scanning with respect to the display panel. Pulse durations of gate scanning signals which are adjacent to each other partially overlap.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

Figure 1:
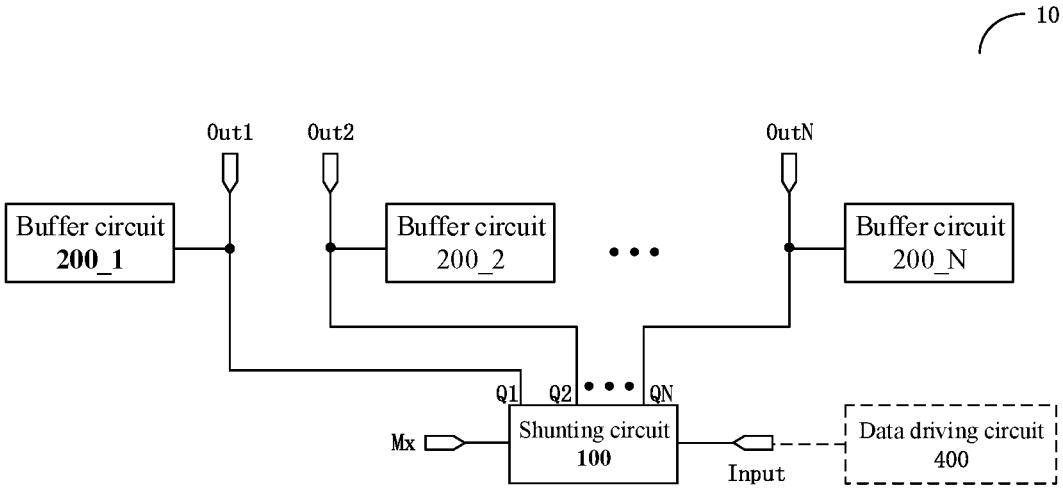
FIG. 1 is a schematic diagram of a signal processing circuit provided by an embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

For example, the pixel array of a display screen normally comprises a plurality of rows of gate lines, and a plurality of columns of data lines that intersect the plurality of rows of gate lines. The gate driving circuit of the display screen provides turning-on and turning-off voltage signals to the plurality of rows of gate lines of the pixel array, so as to, for example, control the plurality of rows of gate lines to be in turned-on state sequentially, such that data signals can be provided to pixel units in corresponding columns of the pixel array via the data lines (e.g., the pixel circuits of the pixel units are compensated or charged under the action of the data signals), so as to form grey-scale voltages, for grey-scales of a displayed image, at the pixel units, such that a frame of the image can be displayed.

In recent years, display screens with high refreshing frequency have received increasing attentions and been widely applied. The refreshing frequency is the times of the repeated scanning, of the display screen in displaying images, within a specific time duration. Display screens with high refreshing frequency can be applied in fields such as film playing, augmented reality display, virtual reality display, e-sports, and display screens with high refreshing frequency can ameliorate image smearing phenomenon, which is caused by display delay, of dynamic pictures, such that the stability of the displayed image is good.

However, high refreshing frequency can cause the compensation time (the charging time) of the pixel circuits in the display screen to be insufficient, such that the quality of the displayed image is significantly decreased, and for example, display mura can present. By taking a 120 Hz AMOLED (Active-Matrix Organic Light Emitting Diode) display screen as an example, at this refreshing frequency, the charging time available for the pixel circuits is 3.3 μs, that is, only half of the charging time of a 60 Hz AMOLED display screen, such that the compensation time of the pixel circuit of the 120 Hz AMOLED display screen is insufficient. The inventor of the present disclosure has noted that insufficient compensation time of the pixel circuit can cause that data voltages to be not fully written, such that the display quality can be adversely affected.

Illustrative descriptions are given to the adverse effect of insufficient compensation time of the pixel circuits on the display quality in the following with reference to FIG. 15A and FIG. 15B.

Figure 15A:
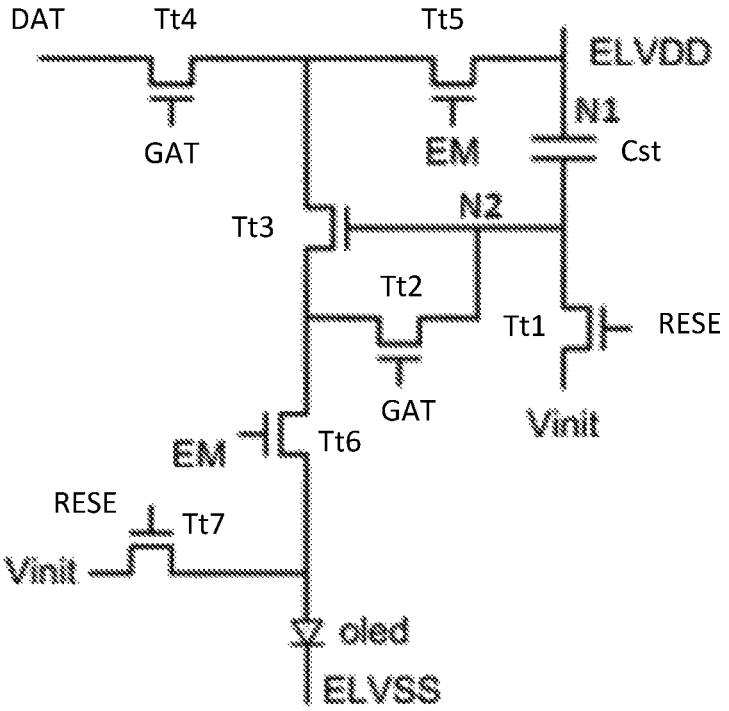
FIG. 15A is a schematic diagram of a pixel circuit.

FIG. 15A illustrates a pixel circuit with threshold compensation capability. As illustrated in FIG. 15A, the pixel circuit is a 7T1C type pixel circuit, that is, a pixel circuit with seven transistors and one storage capacitor. Specifically, the pixel circuit comprises a first transistor Tt1, a second transistor Tt2, a third transistor Tt3, a fourth transistor Tt4, a fifth transistor Tt5, a sixth transistor Tt6, a seventh transistor Tt7, a storage capacitor Cst, a light-emitting element (for example, oled), a first node N1 and a second node N2. The control terminals of the second transistor Tt2 and the fourth transistor Tt4 are configured to be the gating control terminals GAT of the pixel circuit, and the control terminals of the second transistor Tt2 and the fourth transistor Tt4 are connected with a gate line, so as to receive scanning signals. The control terminals of the fifth transistor Tt5 and the sixth transistor Tt6 are configured to be the light-emitting control terminals EM of the pixel circuit, and the control terminals of the fifth transistor Tt5 and the sixth transistor Tt6 are connected with a light-emitting control line, so as to receive light-emitting control signals. The control terminals of the first transistor Tt1 and the seventh transistor Tt7 are configured to be the reset control terminals RESE of the pixel circuit, and the control terminals of the first transistor Tt1 and the seventh transistor Tt7 are connected with a reset line, so as to receive reset signals. The control terminal of the third transistor Tt3 is connected with the second node N2 and the first terminal of the storage capacitor Cst, the first node N1 is connected with a first power source terminal ELVDD, the second terminal of the light-emitting element is connected with a second power source terminal ELVSS; here, the first power source terminal ELVDD and the second power source terminal ELVSS are configured to be constant voltage sources, the voltage Vt1 outputted by the first power source terminal ELVDD, for example, is higher than the voltage Vt2 outputted by the second power source terminal ELVSS, and the voltage Vt2 outputted by the second power source terminal ELVSS is, for example, equal to zero (for example, grounded). The second terminal of the first transistor Tt1 and the first terminal of the seventh transistor Tt7 is configured to receive an initial voltage Vinit, the first terminal of the fourth transistor Tt4 is configured to be the data signal receive terminal DAT of the pixel circuit, and is connected with a data line so as to receive data signals (e.g., data voltage Vdata). Descriptions are given by taking the case that the transistors in the pixel circuit are P-type transistors as an example, but embodiments of the present disclosure are not limited to this case. For example, at least one transistor in the pixel circuit may be an N-type transistor. In the case where the gate electrode of a P-type transistor receives a low electric level signal that is smaller than the threshold voltage of the P-type transistor, the P-type transistor is turned on, and in the case where the gate electrode of a P-type transistor receives a high electric level signal that is larger than the threshold voltage of the P-type transistor, the P-type transistor is turned off.

Figure 15B:
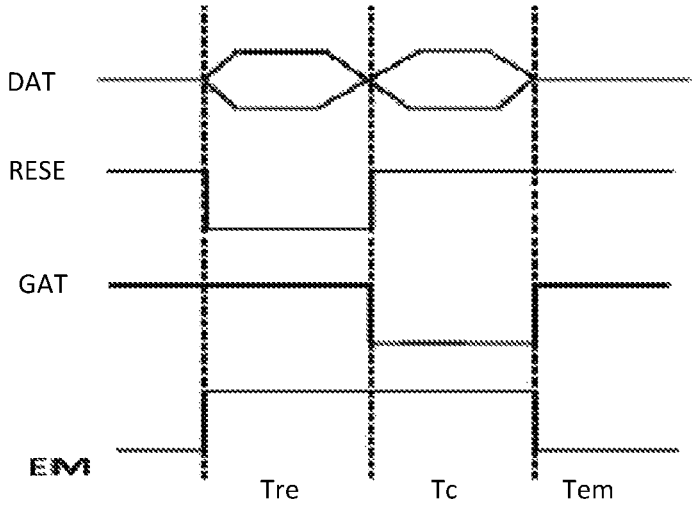
FIG. 15B is a driving timing diagram of the pixel circuit as illustrated in FIG. 15A.

FIG. 15B illustrates a driving timing diagram of the pixel circuit as illustrated in FIG. 15A. As illustrated in FIG. 15B, each driving cycle of the pixel circuit comprises a reset stage Tre, a compensation stage Tc, and a light-emitting stage Tem.

In the reset stage Tre, the reset control terminals RESE of the pixel circuit receive a low electric level signal, so as to allow the first transistor Tt1 and the seventh transistor Tt7 to be turned on, such that the initial voltage Vinit is respectively applied to the anode of the light-emitting element and the second node N2 via the first transistor Tt1 and the seventh transistor Tt7 that are turned on, and the voltages of the anode of the light-emitting element and the second node N2 are set to be the initial voltage Vinit, and therefore, the anode of the light-emitting element and the second node N2 are rest. The initial voltage Vinit allows the third transistor Tt3 (driving transistor) to be in a turned-on state, and in this case, the voltage of the first node N1 is V1.

In the compensation stage Tc, the gating control terminals GAT of the pixel circuit receive a low electric level signal, so as to allow the second transistor Tt2 and the fourth transistor Tt4 to be turned on, and therefore, the data voltage Vdata can be applied to the source electrode of the third transistor Tt3, and the drain electrode of the third transistor Tt3 is electrically connected with the gate electrode of the third transistor Tt3. Because the third transistor Tt3 is in a turned-on state, the storage capacitor Cst can be charged via the drain electrode and the gate electrode of the third transistor Tt3, and the charging process is finished when the voltage of the gate electrode of the third transistor Tt3 is sufficiently increased. In this case, the voltage Vt1 of the source electrode (the first terminal) of the third transistor Tt3 is Vdata, the voltage Vt2 of the drain electrode (the second terminal) and the gate electrode (the control terminal) is changed into Vdata+Vth, that is, the voltage of the second node N2 is also Vdata+Vth, and is stored in the first terminal of the storage capacitor Cst (i.e., the terminal that is connected with the second node N2). Here, Vth is the threshold voltage of the third transistor Tt3, and in this case, the voltage of the first node N1 is still V1.

In the light-emitting stage Tem, the light-emitting control terminals EM receives a low electric level signal, so as to allow the fifth transistor Tt5 and the sixth transistor Tt6 to be turned on, such that the first terminal of the third transistor Tt3 is connected with to the first power source terminal ELVDD via the fifth transistor Tt5 that is turned on, and the voltage Vt1 of the first terminal of the third transistor Tt3 is changed into V1; in this case, under the action of the storage capacitor Cst, the voltage Vtg of the control terminal of the third transistor Tt3, that is, the voltage of the second node N2, is still Vdata+Vth. The current Ids outputted by the third transistor Tt3 in a saturated state can be calculated by the following equations:

$$\begin{aligned} Ids &= 1/2\times K(Vgs-Vth)^2 \\ &= 1/2\times K(Vtg-Vt1-Vth)^2 \\ &= 1/2\times K(Vdata+Vth-V1-Vth)^2 \\ &= 1/2\times K(Vdata-V1)^2. \end{aligned}$$

Here, K=W/L×C×μ, W/L is the width-length ratio (i.e., the ratio between the width and the length) of the channel of the third transistor Tt3, p is the electron mobility, and C is the capacitance per unit area.

Based on the above-mentioned equations, the current Ids outputted by the third transistor Tt3 in the saturated state becomes irrelevant to the threshold voltage, such that the pixel circuit as illustrated in FIG. 15A has a threshold compensation capability.

The inventor of the present disclosure has noted that, when the refreshing frequency of the display panel is increased (e.g., increased from 60 Hz to 120 Hz), because the (pulse duration) time of the scanning signals and the reset signals outputted by the gate driving circuit is decreased, all of the time lengths of reset stage Tre, the compensation stage Tc and the light-emitting stage Tem are reduced (e.g., reduced by half). In this case, because the time length of the compensation stage Tc is relatively short, that is, the data written time is relatively short, the storage capacitor Cst is not sufficiently charged, this can cause the threshold voltage compensation capability of the pixel circuit is insufficient. Illustrative descriptions will be given in the following by taking the pixel circuit as illustrated in FIG. 15A as an example. As illustrated in FIG. 15A, in the case where the time length of the compensation stage Tc is relatively short, the voltage Vt2 of the control terminal of the third transistor Tt3 is difficult to be fully changed into Vdata+Vth, this causes the voltage of the terminal, that is connected with the second node, of the storage capacitor Cst to be not equal to Vdata+Vth (for example, smaller than Vdata+Vth). In this case, the current Ids and the threshold voltage Vth of the third transistor Tt3 still has a certain relationship, such that the threshold voltage compensation capability of the pixel circuit is insufficient, and the compensation effect and the brightness uniformity of the display panel can be reduced. At least an embodiment of the present disclosure provides a signal processing circuit and a driving method thereof, a display panel and a driving method thereof and a display device. The signal processing circuit can prolong the compensation time of the pixel circuits of the display panel, be compatible with a current pixel circuit and a current drive chip, and the problem of insufficient compensation time for the pixel circuits in the display screen with high refresh frequency can be solved, which is in favor of improving display quality.

In the following, embodiments of the present disclosure are described in detail with reference to the accompany drawings. In should be noted that, same one character number in different accompany drawings may refer to same one element that is already described.

At least an embodiment of the present disclosure provide a signal processing circuit, and the signal processing circuit comprises a shunting circuit and N buffer circuits; the shunting circuit comprises N output nodes; the N buffer circuits are respectively connected with the N output nodes; the shunting circuit is configured to output input signals to the N output nodes respectively at N different time points in response to control signals; the buffer circuits are configured to buffer and output the input signals received by corresponding output nodes. Here, N is an integer great than or equal to 2.

FIG. 1 is a schematic diagram of a signal processing circuit provided by an embodiment of the present disclosure. Referring to FIG. 1, the signal processing circuit 10 comprises a shunting circuit (Demux circuit) 100 and N buffer circuits 200, and N is an integer great than or equal to 2.

As illustrated in FIG. 1, the shunting circuit 100 comprises N output nodes, for example, Q1, Q2, . . . , and QN. the shunting circuit 100 is configured to output the received input signals to the N output nodes respectively at N different time points in response to the received control signals. For example, the shunting circuit 100 is connected with an input control terminal Mx and an input terminal Input, and is configured to allow the input signals provided by the input terminal Input to be outputted to Q1, Q2, . . . , and QN respectively at N different time points under the control of the control signal provided by the input control terminal Mx. The data information carried by the input signals at N different time points may be different. For example, the input terminal Input may be connected with a data driving circuit 400 which is provided outside the signal processing circuit 10, so as to receive display data signals, which serve as the input signals, provided by the data driving circuit 400. For example, the data driving circuit 400 may be a data driver or a data driving chip in the display device, and is configured to provide the display data signals to a plurality of pixel units, and the display data signals are the above-mentioned input signals.

It should be understood that, no specific limitation will be given in embodiments of the present disclosure regarding the number of the output nodes, for example, the number of the output nodes may be two, three, four or any other number, as long as the number of the output nodes is guaranteed to be larger than or equal to 2. For example, no specific limitation will be given in embodiments of the present disclosure regarding the number of the control signals, according to demands, the number of the control signal(s) may be any number. Correspondingly, no specific limitation will be given in embodiments of the present disclosure regarding the number of the input control terminal(s) Mx, as long as the number of the input control terminal(s) Mx is equal to the number of the control signal(s).

The N buffer circuits 200 are respectively connected with the N output nodes and are configured to buffer and output the input signals received by corresponding output nodes. For example, the buffer circuit 200_1 is connected with a first output node Q1 and a first output terminal Out1, and is configured to buffer and output the input signal received by the first output node Q1 to the first output terminal Out1, and to maintain the output within a pre-determined time period; the buffer circuit 200_2 is connected with a second output node Q2 and a second output terminal Out2 and is configured to buffer and output the input signal received by the second output node Q2 to the second output terminal Out2, and to maintain the output within a pre-determined time period, and so on. For example, N output terminals Out1, Out2, . . . , and OutN may be respectively connected with N data lines, so as to provide the inputted data signals to the pixel units. For example, the number of the buffer circuits 200 is equal to the number of the output nodes, so as to guarantee that the buffer circuits 200 and the output nodes are respectively connected in one-to-one correspondence.

Figure 2:
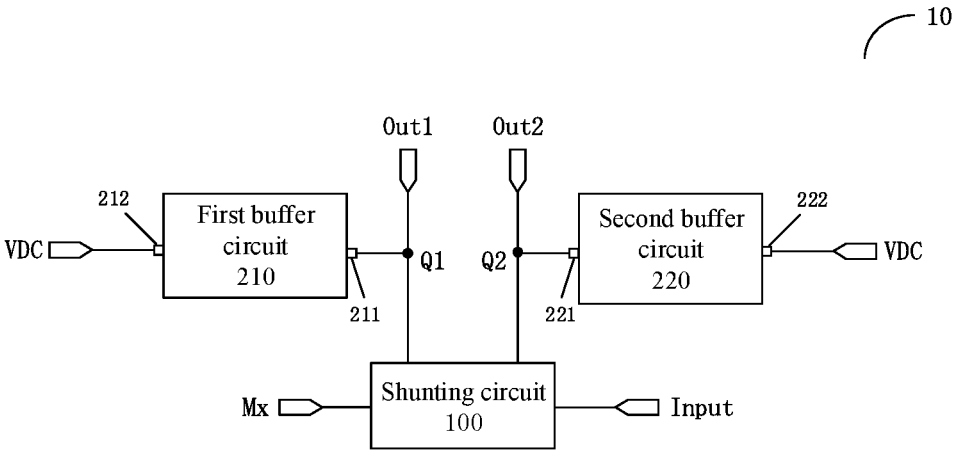
FIG. 2 is a schematic diagram of another signal processing circuit provided by an embodiment of the present disclosure.

FIG. 2 is a schematic diagram of another signal processing circuit provided by an embodiment of the present disclosure. Referring to FIG. 2, the signal processing circuit 10 comprises the shunting circuit 100, a first buffer circuit 210, and a second buffer circuit 220. The shunting circuit 100 comprises the first output node Q1 and the second output node Q2.

The first terminal 211 of the first buffer circuit 210 is configured to be connected with a corresponding output node (i.e., the first output node Q1), and the second terminal 212 of the first buffer circuit 210 is configured to be connected with a first voltage terminal VDC so as to receive a first voltage. The first terminal 221 of the second buffer circuit 220 is configured to be connected with a corresponding output node (i.e., the second output node Q2), and the second terminal 222 of the second buffer circuit 220 is configured to be connected with the first voltage terminal VDC so as to receive the first voltage. For example, the first voltage terminal VDC is a DC (direct-current) voltage terminal and the first voltage terminal VDC may provide a DC signal with a high voltage level (e.g., VDD) or may provide a DC signal with a low voltage level (e.g., VSS), and no specific limitation will be given in embodiments of the present disclosure in this respect. The shunting circuit 100 here is similar to the shunting circuit 100 as illustrated in FIG. 1, and no further description will be given here.

In the case where the control signal provided by the input control terminal Mx is at a valid electric level, the shunting circuit 100 output the input signals provided by the input terminal Input to the first output node Q1 and the second output node Q2 respectively at different time points. For example, at the first time point, the shunting circuit 100 outputs an input signal to the first output node Q1 in response to the control signal, and maintains the output within a pre-determined time period; later, at the second time point, the shunting circuit 100 outputs an input signal to the second output node Q2 in response to the control signal, and maintains the output within a pre-determined time period; then, at the third time point, the shunting circuit 100 outputs an input signal to the first output node Q1 again in response to the control signal, and maintains the output within a pre-determined time period, and so on. In the subsequent time points, the shunting circuit 100 adopts the above-mentioned method to output the input signals to the first output node Q1 and the second output node Q2 alternately and repeatedly. The first buffer circuit 210 buffers and outputs the input signal received by the first output node Q1 to the first output terminal Out1, and the second buffer circuit 220 buffers and outputs the input signal received by the second output node Q2 to the second output terminal Out2.

By this way, the input signals are divided into two sub-signals, and the frequency of the sub-signals is half of the frequency of the input signals, that is, the cycle of the sub-signals is two times as much as the cycle of the input signals. For example, by providing the sub-signals to the pixel units of the display panel, so as to serves as the display data signal, the pixel circuits in the pixel units can be compensated or charged in response to the gate scanning signals under the action of the display data signals, such that the compensation time of the pixel circuits is allowed to be prolonged to two times as much as the original compensation time, the data voltages can be written more fully, and the display quality can be improved. It should be understood that, in embodiments of the present disclosure, the extension value of the compensation time is related to the frequency of the input signal and the number of the output nodes and the number of the buffer circuits. In the case where the frequency of the input signal is a constant value, the number of the output nodes and the number of the buffer circuits may be set according to actual demands, so as to allow the extension value of the compensation time to satisfy demands.

Figure 3:
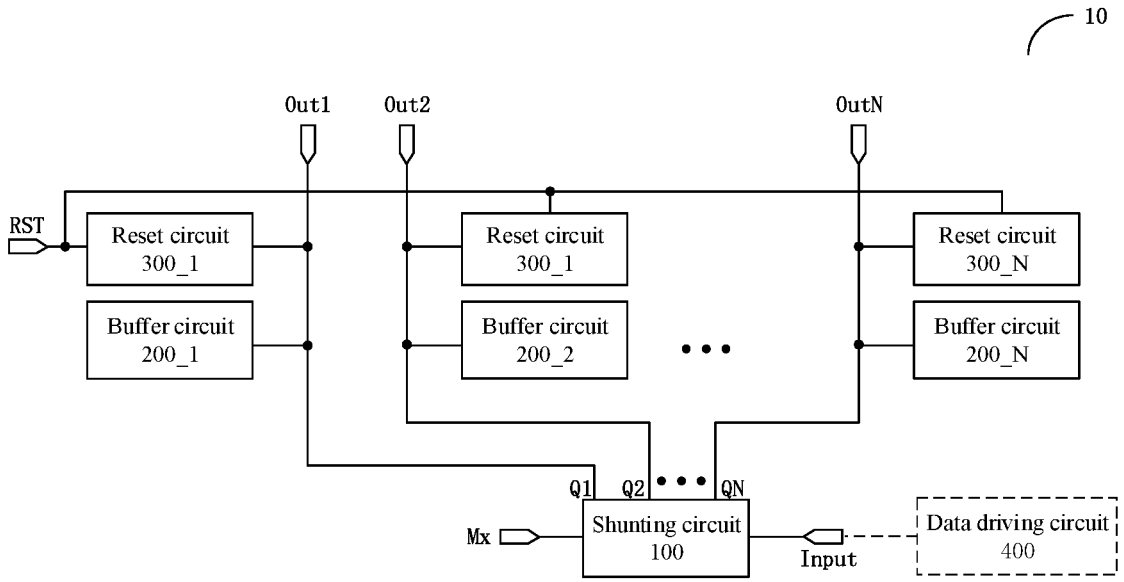
FIG. 3 is a schematic diagram of still another signal processing circuit provided by an embodiment of the present disclosure.

FIG. 3 is a schematic diagram of another signal processing circuit provided by an embodiment of the present disclosure. Referring to FIG. 3, the signal processing circuit 10 as illustrated in FIG. 3 is substantially the same as the signal processing circuit 10 as illustrated in FIG. 1 except that the signal processing circuit 10 as illustrated in FIG. 3 further comprises N reset circuits 300. In the present embodiment, the N reset circuits 300 are respectively connected with the N output nodes, and the N reset circuits 300 are configured to reset the N output nodes (i.e., to reset the N buffer circuits 200) in response to the reset signal provided by the reset signal line (the reset signal terminal RST). For example, the reset circuit 300_1 is connected with the reset signal terminal RST and the first output node Q1, the reset circuit 300_2 is connected with the reset signal terminal RST and the second output node Q2, and so on.

It should be understood that, in embodiments of the present disclosure, the number of the reset circuits 300 is not limited, and may be set according to the number of the output nodes and the number of the buffer circuits 200. For example, the number of the reset circuits 300 is equal to the number of the output nodes and equal to the number of the buffer circuits 200, and each of the reset circuits 300 resets the buffer circuit 200 that is connected with this reset circuit 300.

For example, when the display panel is in operation, the scan sequence of each frame comprises a blanking time period and an effective time period. During the effective time period, progressive scanning is performed with respect to the pixel circuits of the pixel units so as to display an image; in the blanking time period, scanning operations does not performed with respect to the pixel circuits. For example, the reset circuits 300 reset the buffer circuits 200 during the blanking time period, so as to allow the display data signals of next frame of image to be buffered into the buffer circuits 200 more accurately and more quickly, such that the display quality can be improved. For example, the reset circuits 300 may also reset the buffer circuits 200 before scanning each frame of image or after the scanning of each frame of image is finished; and the reset circuits 300 may also reset the buffer circuits 200 at a designated time point (e.g., before writing data into each row of pixel units).

Figure 4:
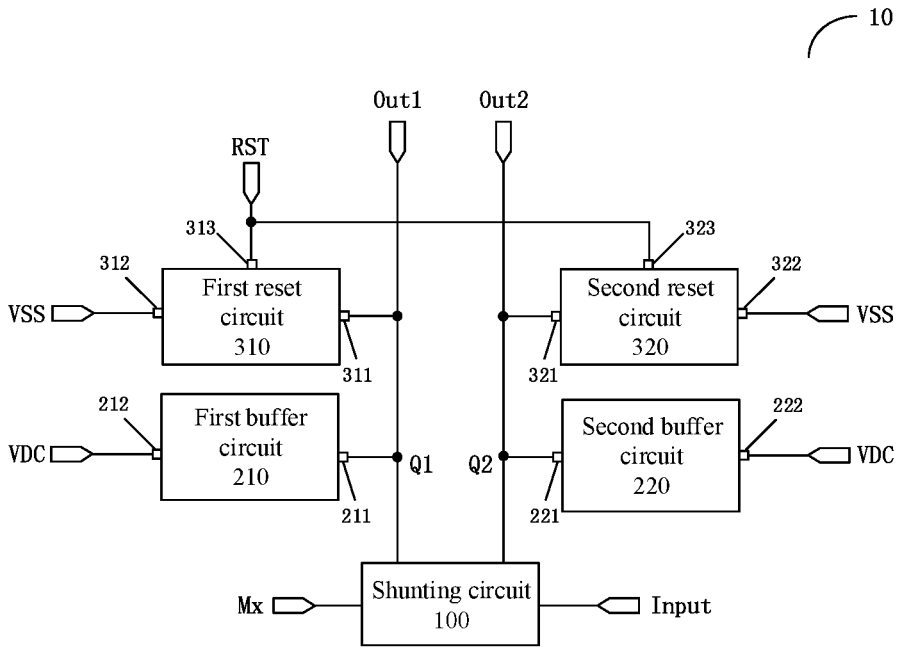
FIG. 4 is a schematic diagram of further still another signal processing circuit provided by an embodiment of the present disclosure.

FIG. 4 is a schematic diagram of another signal processing circuit provided by an embodiment of the present disclosure. Referring to FIG. 4, the signal processing circuit 10 in the present embodiment is substantially the same as the signal processing circuit 10 as illustrated in FIG. 2 except that the signal processing circuit 10 in the present embodiment further comprises a first reset circuit 310 and a second reset circuit 320. In the present embodiment, the first reset circuit 310 is connected with the first output node Q, and the first reset circuit 310 is configured to reset the first buffer circuit 210 in response to the reset signal provided by the reset signal line (the reset signal terminal RST). The second reset circuit 320 is connected with the second output node Q2, and is configured to reset the second buffer circuit 220 in response to the reset signal provided by the reset signal line (the reset signal terminal RST).

For example, the first terminal 311 of the first reset circuit 310 is configured to be connected with the first output node Q1, the second terminal 312 of the first reset circuit 310 is configured to be connected with a second voltage terminal VSS, so as to receive a second voltage, and the control terminal 313 of the first reset circuit 310 is configured to be connected with the reset signal line (the reset signal terminal RST), so as to receive the reset signal. The first terminal 321 of the second reset circuit 320 is configured to be connected with the second output node Q2, the second terminal 322 of the second reset circuit 320 is configured to be connected with the second voltage terminal VSS, so as to receive the second voltage, and the control terminal 323 of the second reset circuit 320 is configured to be connected with the reset signal line (the reset signal terminal RST), so as to receive the reset signal. For example, the second voltage terminal VSS provides a direct-current signal with a low voltage level (e.g., is grounded), the direct-current signal with a low voltage level is referred to as the second voltage and serves as the reset voltage; or, the second voltage terminal VSS may also provide a direct-current signal with a high voltage level. For example, in the case where the first voltage terminal VDC provides the direct-current signal with a high voltage level, the second voltage terminal VSS is equivalent to the first voltage terminal VDC.

In the case where the reset signal is at a valid electric level, the first reset circuit 310 allow the second voltage terminal VSS and the first output node Q1 to be electrically connected, and the second reset circuit 320 allows the second voltage terminal VSS and the second output node Q2 to be electrically connected, so as to reset the first output node Q1, the first buffer circuit 210, the second output node Q2 and the second buffer circuit 220. For example, the reset operation may be performed before scanning each frame of image or after scanning of each frame of image is finished. Obviously, embodiments of the present disclosure are not limited to this case. The reset operation may be performed at a designated time point according to specific implementation requirements, for example, the reset operation may be performed before buffering data by corresponding buffer circuits. Through reset operation, the input signals (e.g., the display data signals) are allowed to be buffered in the first buffer circuit 210 and the second buffer circuit 220 more accurately and more quickly, such that the display quality is improved.

Figure 5:
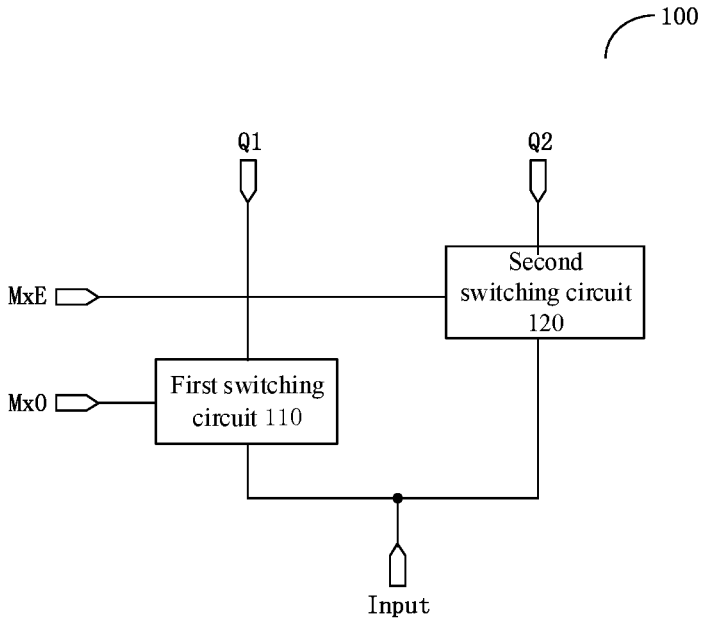
FIG. 5 is a schematic diagram of a shunting circuit of a signal processing circuit provided by an embodiment of the present disclosure.

FIG. 5 is a schematic diagram of a shunting circuit of a signal processing circuit provided by an embodiment of the present disclosure. Referring to FIG. 5, the shunting circuit 100 comprises an input terminal Input, a first input control terminal MxO, a second input control terminal MxE, a first switching circuit 110 and a second switching circuit 120. The first switching circuit 110 is connected with the input terminal Input, the first output node Q1 and the first input control terminal MxO, and is configured to output an input signal that is received by the input terminal Input to the first output node Q1 in response to the first control signal received by the first input control terminal MxO. The second switching circuit 120 is connected with the input terminal Input, the second output node Q2 and the second input control terminal MxE, and is configured to output an input signal received by the input terminal Input to the second output node Q2 in response to the second control signal received by the second input control terminal MxE.

In the case where the first control signal is at a valid electric level (i.e., the electric level that allows the first switching circuit 110 to be turned on), the first switching circuit 110 connects the first output node Q1 with the input terminal Input, so as to allow the input signal to be outputted to the first output node Q1. In the case where the second control signal is at a valid electric level (i.e., the electric level that allows the second switching circuit 120 to be turned on, the second switching circuit 120 connects the second output node Q2 with the input terminal Input, so as to allow the input signal to be outputted to the second output node Q2. For example, the first control signal and the second control signal alternately switched to be a valid electric level, so as to allow the input signal to be alternately outputted to the first output node Q1 and the second output node Q2.

It should be understood that, in embodiments of the present disclosure, the number of the switching circuits is not limited, and the number of the switching circuits may be set according to specific implementation requirements. In an example of the present embodiment, descriptions are given by taking the case where the shunting circuit 100 comprises two switching circuits (the first switching circuit 110 and the second switching circuit 120) as an example. For example, in other examples, the shunting circuit 100 comprises N switching circuits, correspondingly, the number of the input control terminals and the number of the output nodes are respectively equal to N, the N switching circuits are connected with the input terminal Input, and the N switching circuits are respectively connected with the N output nodes in one-to-one correspondence, and respectively connected with the N input control terminals in one-to-one correspondence. N is an integer great than or equal to 2.

Figure 6:
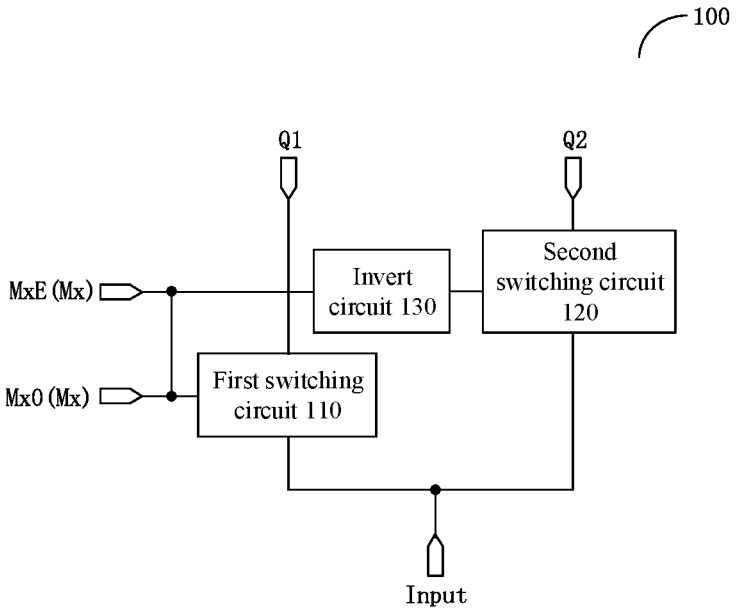
FIG. 6 is a schematic diagram of another shunting circuit of a signal processing circuit provided by an embodiment of the present disclosure.

FIG. 6 is a schematic diagram of a shunting circuit of another signal processing circuit provided by an embodiment of the present disclosure. Referring to FIG. 6, the shunting circuit 100 in the present embodiment is substantially the same as the shunting circuit 100 as illustrated in FIG. 5, except that the connection of the input control terminals is different and the shunting circuit 100 further includes an invert circuit 130. In the present embodiment, the first input control terminal MxO and the second input control terminal MxE are connected with each other, and are connected with the same input control line (the input control terminal Mx), so as to receive the same control signal. The second switching circuit 120 is connected with the second input control terminal MxE through the invert circuit 130. That is, the phase of the control signal received by the second switching circuit 120 and the phase of the control signal received by the first switching circuit 110 are reversed to each other, such that alternately controlling of the first switching circuit 110 and the second switching circuit 120 can be realized.

For example, in the case where the control signals of the first input control terminal MxO and the second input control terminal MxE are at a valid electric level (i.e., the electric level that allows the first switching circuit 110 to be turned on), the first switching circuit 110 is electrically connects the first output node Q1 with the input terminal Input, and the control signal received by the second switching circuit 120 is an invalid electric level (i.e., the electric level that allows the second switching circuit 120 to be turned off) because of the function of the invert circuit 130, so as to allow the second output node Q2 and the input terminal Input to be disconnected. In the case where the control signals of the first input control terminal MxO and the second input control terminal MxE are an invalid electric level, the first switching circuit 110 allows the first output node Q1 and the input terminal Input to be disconnected, and in this case, because of the function of the invert circuit 130, the control signal received by the second switching circuit 120 is at a valid electric level, so as to allow the second output node Q2 is electrically connected with the input terminal Input.

By the above-mentioned methods, alternately controlling of the first switching circuit 110 and the second switching circuit 120 can be realized by adopting same one control signal, such that the control method for the circuit can be simplified, the number of the signals can be reduced, the cross-talk between signals can be avoided, and thus the signal isolation degree between the first output node Q1 and the second output node Q2 can be enhanced. It should be understood that, in embodiments of the present disclosure, the arrangements of the invert circuit 130 is not limited, and the invert circuit 130 may be connected with any one of the first switching circuit 110 and the second switching circuit 120, the arrangements may be set according to specific implementation requirements, and for example, the arrangements may be set according to the cooperation relationship between the control signals and the switching circuit.

Figure 7:
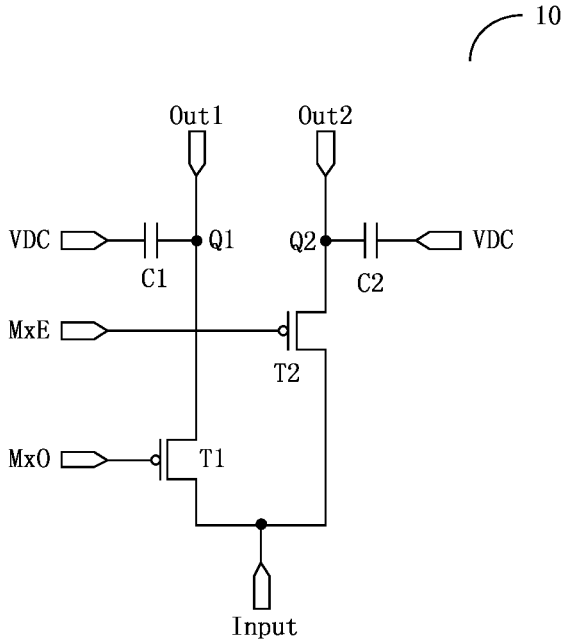
FIG. 7 is a circuit diagram of a specific implementation example of the signal processing circuit as illustrated in FIG. 2.

FIG. 7 is a circuit diagram of a specific implementation example of the signal processing circuit as illustrated in FIG. 2. In the following descriptions, unless otherwise defined, the descriptions are given by taking the case that each transistor is a P-type transistor as an example, but this should not be construed as a limitation on the embodiments of the present disclosure. Referring to FIG. 7, the signal processing circuit 10 comprises a first transistor T1, a second transistor T2, a first capacitor C1 and a second capacitor C2.

For example, the shunting circuit 100 comprises a first switching circuit 110 and a second switching circuit 120. As illustrated in FIG. 7, the first switching circuit 110 may be implemented as the first transistor T1, and the first transistor T1 serves as a switching transistor. The gate electrode of the first transistor T1 is connected with the first input control terminal MxO, the first terminal of the first transistor T1 is connected with the input terminal Input, and the second terminal of the first transistor T1 is connected with the first output node Q1. The second switching circuit 120 may be implemented as the second transistor T2, and the second transistor T2 serves as a switching transistor. The gate electrode of the second transistor T2 is connected with the second input control terminal MxE, the first terminal of the second transistor T2 is connected with the input terminal Input, and the second terminal of the second transistor T2 is connected with the second output node Q2. In the case where the first control signal provided by the first input control terminal MxO and the second control signal provided by the second input control terminal MxE are alternately a valid electric level, the first transistor T1 and the second transistor T2 are alternately turned on, so as to allow the input signals of the input terminal Input to be alternately outputted to the first output node Q1 and the second output node Q2.

The first buffer circuit 210 may be implemented as the first capacitor C1. The first electrode, that serves as the first terminal 211 of the first buffer circuit 210, of the first capacitor C1 is connected with the first output node Q1, the second electrode, that serves as the second terminal 212 of the first buffer circuit 210, of the first capacitor C1 is connected with the first voltage terminal VDC. The first capacitor C1 can buffer the input signal received by the first output node Q1, and output the input signal to the first output terminal Out1.

The second buffer circuit 220 may be implemented as the second capacitor C2. The first electrode, that serves as the first terminal 221 of the second buffer circuit 220, of the second capacitor C2 is connected with the second output node Q2, the second electrode, that serves as the second terminal 222 of the second buffer circuit 220, of the second capacitor C2 is connected with the first voltage terminal VDC. The second capacitor C2 can buffer the input signal received by the second output node Q2, and output the input signal to the second output terminal Out2.

Figure 8:
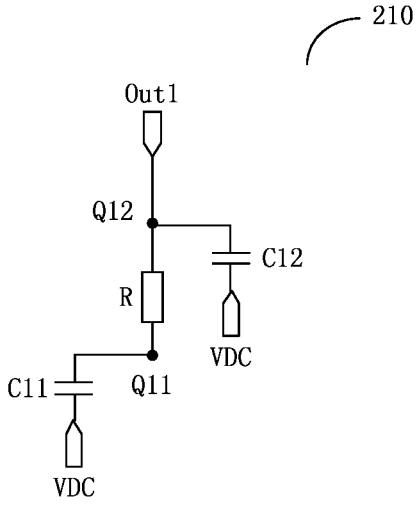
FIG. 8 is a circuit diagram of a specific implementation example of a buffer circuit of a signal processing circuit provided by an embodiment of the present disclosure.

For example, in the display panel, because of the influence of the wire arrangements, the buffer circuits 200 may be implemented as the circuit structures as illustrated in FIG. 8, and in the present embodiment, descriptions are given by taking the first buffer circuit 210 as an example. Referring to FIG. 8, the first buffer circuit 210 comprises a first sub-capacitor C11, a second sub-capacitor C12 and a resistor R. The first electrode of the first sub-capacitor C11 is connected with a first sub-node Q11, and the second electrode of the first sub-capacitor C11 is connected with the first voltage terminal VDC. The first electrode of the second sub-capacitor C12 is connected with a second sub-node Q12, and the second electrode of the second sub-capacitor C12 is connected with the first voltage terminal VDC. The first terminal of the resistor R is connected with the first sub-node Q11, and the second terminal of the resistor R is connected with the second sub-node Q12. The shunting circuit 100 outputs the input signal to the first sub-node Q11 in response to the control signal, and the first buffer circuit 210 buffers the input signal and outputs the input signal to the first output terminal Out1 through the second sub-node Q12.

For example, the first sub-capacitor C11 is a capacitor device that is formed on the display panel through manufacturing processes, for example, the capacitor device may be realized by forming dedicated capacitor electrodes, the capacitor electrodes may be realized through metal layers, semiconductor layers (for example, doped polycrystalline silicon), etc. For example, the second sub-capacitor C12 is a parasitic capacitor between data lines in the display panel, and the second sub-capacitor C12 may be realized by a parasitic capacitor between a data line and other device or wire. For example, the resistor R corresponds to the resistance of the data line in the display panel instead of a resistor device that actually existed.

It should be understood that, in embodiments of the present disclosure, the capacitances of the parasitic capacitors (the second sub-capacitor C12) in the buffer circuits 200 may be the same or different, and this is related to the wire arrangements of the data lines in the display panel. Therefore, in order to guarantee the reference point of the outputted signals of the buffer circuits 200 to be the same, the capacitances of the first sub-capacitors C11 in the buffer circuits 200 may be adjusted according to the capacitances of corresponding parasitic capacitors. That is, the capacitances of the first sub-capacitors C11 of the buffer circuits 200 may be the same or different. For example, in other examples, by adjusting the wire arrangements of the data lines, the parasitic capacitors of the buffer circuits 200 satisfy the requirements on the capacitances, and therefore, the first sub-capacitor C11 can be omitted, and buffering of the input signals can be realized only based on the parasitic capacitors. In this case, no dedicated capacitor device needs to be formed in the buffer circuit 200, and forming of the capacitor device through manufacturing processes is unnecessary, and therefore, the costs can be reduced and manufacturing efficiency can be promoted.

Figure 9:
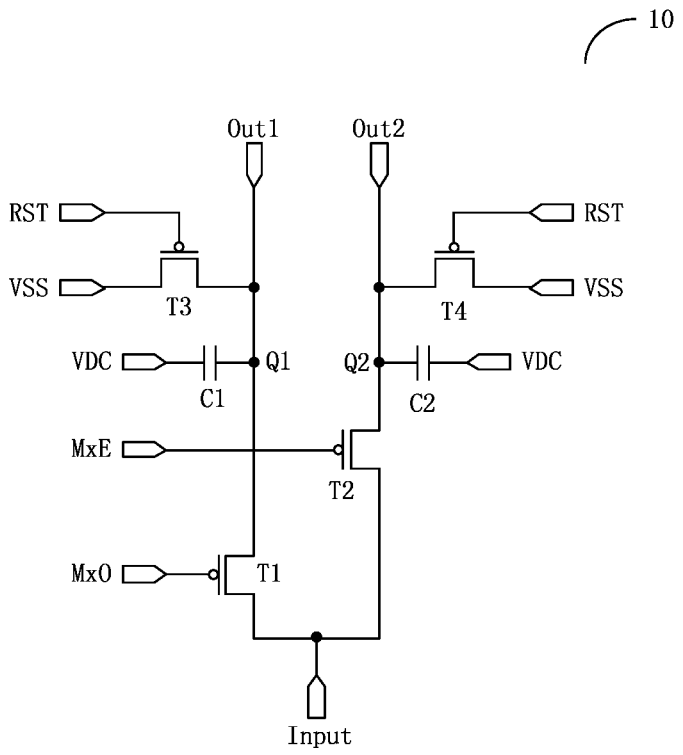
FIG. 9 is a circuit diagram of a specific implementation example of the signal processing circuit as illustrated in FIG. 4.

FIG. 9 is a circuit diagram of a specific implementation example of the signal processing circuit as illustrated in FIG. 4. Referring to FIG. 9, the signal processing circuit 10 in the present embodiment is substantially the same as the signal processing circuit 10 as illustrated in FIG. 7, except for further including of a third transistor T3 and a fourth transistor T4. In the present embodiment, the first reset circuit 310 may be implemented as the third transistor T3, and the third transistor T3 serves as a reset transistor. The first terminal, that serves as the first terminal 311 of the first reset circuit 310, of the third transistor T3 is connected with the first output node Q1, the second terminal, that serves as the second terminal 312 of the first reset circuit 310, of the third transistor T3 is connected with the second voltage terminal VSS, and the gate electrode, that serves as the control terminal 313 of the first reset circuit 310, of the third transistor T3 is connected with the reset signal line (the reset signal terminal RST). The third transistor T3 is turned on in the case where the reset signal is at a valid electric level, so as to allow the first output node Q1 to be electrically connected with the second voltage terminal VSS, such that the first buffer circuit 210 (the first capacitor C1) can be reset.

The second reset circuit 320 may be implemented as the fourth transistor T4, and the fourth transistor T4 serves as a reset transistor. The first terminal, that serves as the first terminal 321 of the second reset circuit 320, of the fourth transistor T4 is connected with the second output node Q2, the second terminal, that serves as the second terminal 322 of the second reset circuit 320, of the fourth transistor T4 is connected with the second voltage terminal VSS, and the gate electrode, that serves as the control terminal 323 of the second reset circuit 320, of the fourth transistor T4 is connected with the reset signal line (the reset signal terminal RST). The fourth transistor T4 is turned on in the case where the reset signal is at a valid electric level, so as to allow the second output node Q2 to be electrically connected with the second voltage terminal VSS, such that the second buffer circuit 220 (the second capacitor C2) can be reset.

Figure 10A:
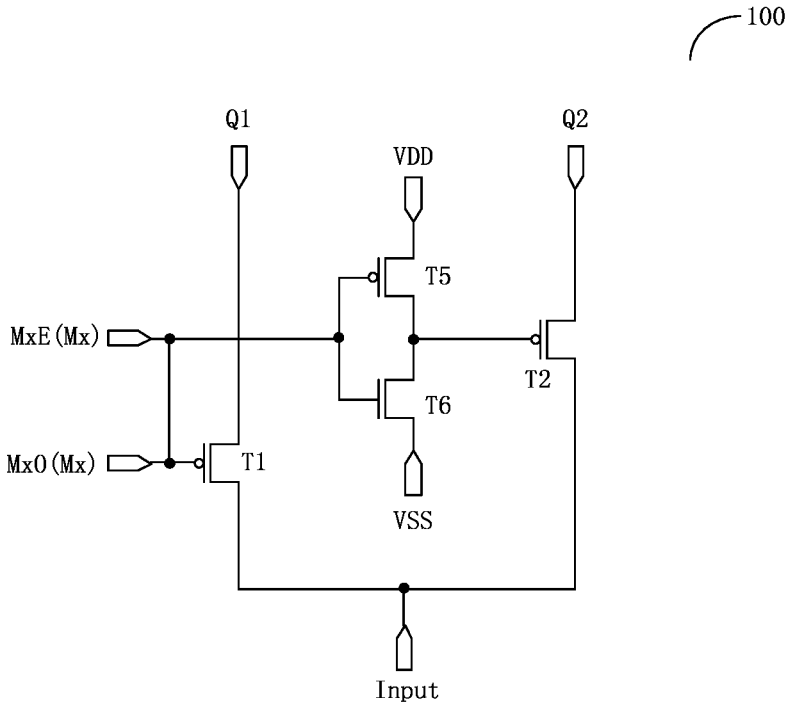
FIG. 10A is a circuit diagram of a specific implementation example of a shunting circuit in the signal processing circuit as illustrated FIG. 6.

FIG. 10A is circuit diagram of a specific implementation example of the shunting circuit in the signal processing circuit as illustrated FIG. 6. In the present embodiment, the first shunting circuit 110 and the second shunting circuit 120 in the shunting circuit 100 is substantially the same as the circuit as illustrated in FIG. 7, and no further description will be given here. Referring to FIG. 10A, the invert circuit 130 may be implemented as a fifth transistor T5 and a sixth transistor T6. The gate electrode of the fifth transistor T5 and the gate electrode of the sixth transistor T6 are connected, and are further connected with the second input control terminal MxE, the first terminal of the fifth transistor T5 is connected with a third voltage terminal VDD so as to receive a third voltage, the second terminal of the fifth transistor T5 and the first terminal of the sixth transistor T6 are connected and are further connected with the gate electrode of the second transistor T2, and the second terminal of the sixth transistor T6 is connected with the second voltage terminal VSS. The first input control terminal MxO and the second input control terminal MxE are connected with each other, and further connected with the same input control line (the input control terminal Mx), so as to receive the same control signal. For example, the third voltage terminal VDD provides a direct-current signal with a high electric level, and the direct-current signal with a high electric level is referred to as the third voltage.

For example, in the case where the control signals of the first input control terminal MxO and the second input control terminal MxE are at a low electric level, the first transistor T1 is turned on. In this case, the fifth transistor T5 is turned on as well, so as to allow the third voltage terminal VDD is electrically connected with the gate electrode of the second transistor T2, such that the gate electrode of the second transistor T2 receives a high electric level signal, the second transistor T2 is turned off. It should be noted that, the sixth transistor T6 is an N-type transistor, and thus, in this case, the sixth transistor T6 is turned off.

In the case where the control signals of the first input control terminal MxO and the second input control terminal MxE are at a high electric level, the first transistor T1 is turned off. In this case, the sixth transistor T6 is turned on to allow the second voltage terminal VSS is electrically connected with the gate electrode of the second transistor T2, so as to allow the gate electrode of the second transistor T2 to receive a low electric level signal, and to allow the second transistor T2 to be turned on. In this case, the fifth transistor T5 is turned off.

Figure 10B:
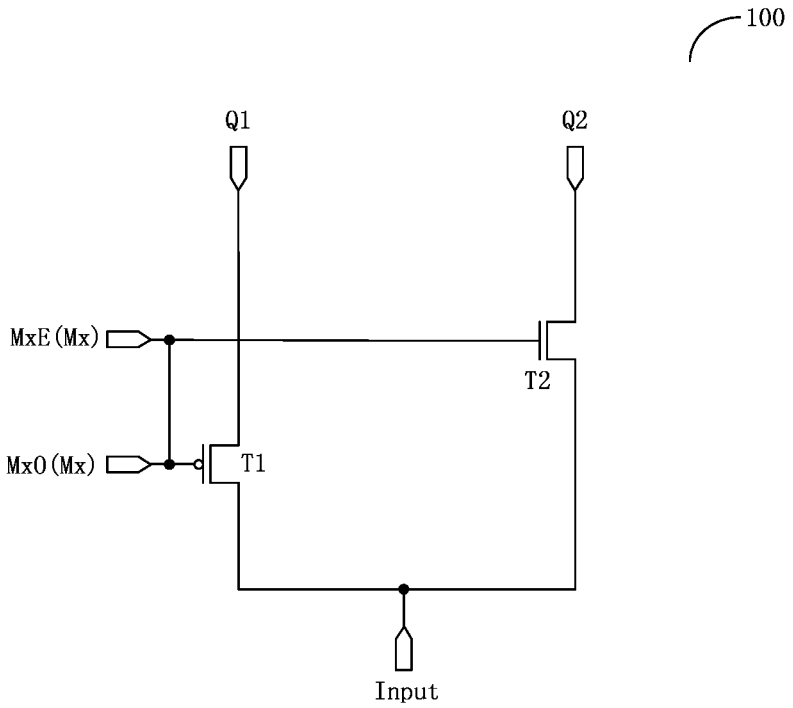
FIG. 10B is a circuit diagram of another specific implementation example of a shunting circuit in the signal processing circuit as illustrated FIG. 6.

FIG. 10B is a circuit diagram of another specific implementation example of the shunting circuit in the signal processing circuit as illustrated FIG. 6. In the present embodiment, the first shunting circuit 110 and the second shunting circuit 120 in the shunting circuit 100 are respectively transistors of different types. For example, the first transistor T1 is a P-type transistor, and the second transistor T2 is an N-type transistor. The first input control terminal MxO and the second input control terminal MxE are connected with each other, and are connected to the same input control line (the input control terminal Mx), so as to receive the same control signal. For example, in the case where the control signal is at a low electric level, the first transistor T1 is turned on, and the second transistor T2 is turned off; in the case where the control signal is at a high electric level, the first transistor T1 is turned off, and the second transistor T2 is turned on.

Through the above-mentioned method, phase reversion operation can be performed with respect to the control signals for the first input control terminal MxO and the second input control terminal MxE, and controlling of the first transistor T1 and the second transistor 12 can be realized by adopting only one control signal, such that the control method for the circuit can be simplified, the number of the signals can be reduced, the cross-talk between signals can be avoided, and thus the signal isolation degree between the first output node Q1 and the second output node Q2 can be enhanced.

It should be noted that, in the descriptions of embodiments of the present disclosure, N output nodes (Q1, Q2, . . . , and QN) are not components that are actually existed, and are intend to represent the conjunction of related electrically connections in the circuit diagram.

It should be understood that the transistors adopted in the embodiments of present disclosure may be thin film transistors or field-effect transistors or other switching devices with similar characteristics. Descriptions are given by taking the case that the transistors adopted in embodiments of present disclosure are thin film transistors as an example. A source electrode and a drain electrode of the transistor adopted here may be symmetrical in structure, and therefore, there is no difference in the structures of the source electrode and the drain electrode of the transistor. In the embodiments of present disclosure, in order to distinguish two terminals of the transistors other than a gate electrode, one terminal of the two terminals is denoted as a first terminal, and the other terminal of the two terminals is denoted as a second terminal.

In addition, descriptions are given by taking the case that transistors, except for the sixth transistor T6, adopted in embodiments of present disclosure are P-type transistors as an example, and in this case, the first terminal of the transistor is the source electrode, and the second terminal is the drain electrode. It should be understood that, the present disclosure comprises, but not limited to, this case. For example, one or more transistors in the signal processing circuit 10 provided by embodiments of the present disclosure may also adopt N-type transistor(s), and in this case, the first terminal of transistor is the drain electrode, and the second terminal is the source electrode, and the terminals of the transistors of a selected type can be connected corresponding by referring to the connections of the terminals of corresponding transistors in embodiments of the present disclosure. In the case where N-type transistors are adopted, indium gallium zinc oxide (IGZO), which serves as the active layers of the thin film transistors, can be adopted, and thus the sizes of the transistors can be effectively reduced and current leaking can be effectively avoided, as compared to the case where low temperature poly silicon (LTPS) or amorphous silicon (for example, hydrogenated amorphous silicon) serves as the active layers of the thin film transistors.

Figure 11:
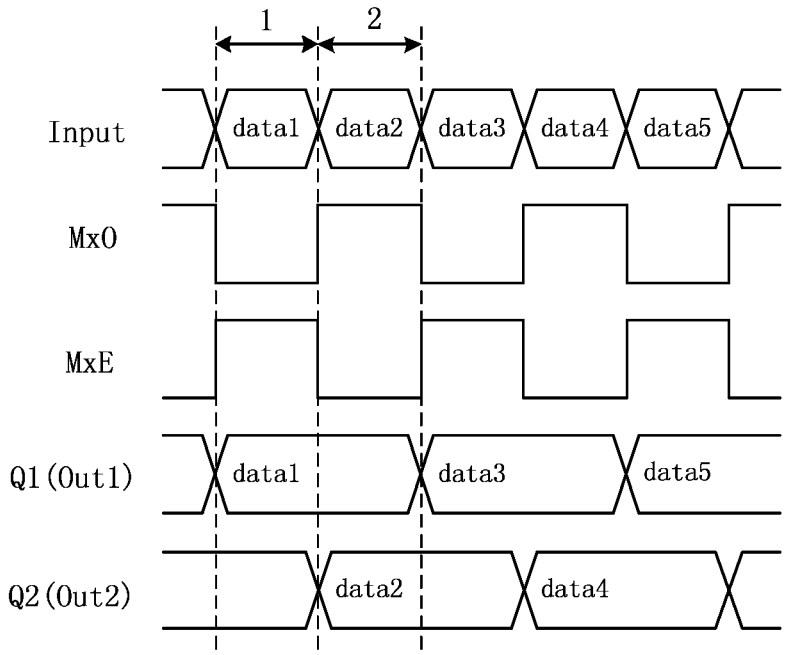
FIG. 11 is a signal timing diagram of a signal processing circuit provided by an embodiment of the present disclosure.

FIG. 11 is a signal timing diagram of a signal processing circuit provided by an embodiment of the present disclosure. The working principle of the signal processing circuit 10 as illustrated in FIG. 7 is described with reference to the signal timing diagram as illustrated in FIG. 11, and here, descriptions are given by taking the case that the transistors are P-type transistors as an example, but embodiments of the present disclosure are not limited to this case.

For example, when the signal processing circuit 10 is in operation, the control signals (provided by the first input control terminal MxO and the second input control terminal MxE) and the input signals (provided by the input terminal Input) are provided, so as to allow the shunting circuit 100 to sequentially output the input signals to two output nodes (the first output node Q1 and the second output node Q2) respectively at two different time points in response to the control signals, to allow the first buffer circuit 210 to buffer and output the input signal received by the first output node Q1 to the first output terminal Out1, and to allow the second buffer circuit 220 to buffer and output the input signal received by the second output node Q2 to the second output terminal Out2. In the first stage 1 and the second stage 2 as illustrated in FIG. 11, the signal processing circuit 10 can respectively performs the following operations.

In the first stage 1, the first input control terminal MxO provides a low electric level signal, and the first transistor T1 is turned on, so as to allow the input signal at this time point to output to the first output node Q1. For example, the input signal at this time point is a first data data1. The first capacitor C1 buffers the first data data1 and is able to continuously output the first data data1 within a pre-determined time period. The second input control terminal MxE provides a high electric level signal, the second transistor T2 is turned off, and the second output node Q2 keeps the signal from the last stage or keeps the signal after resetting.

In the second stage 2, the second input control terminal MxE provides a low electric level signal, the second transistor T2 is turned on, so as to allow the input signal at this time point to output to the second output node Q2. For example, the input signal at this time point is a second data data2. The second capacitor C2 buffers the second data data2 and may continuously output the second data data2 within a pre-determined time period. The first input control terminal MxO provides a high electric level signal, the first transistor T1 is turned off, and the first output node Q1 keeps the signal from the last stage (i.e., the first data data1) or keeps the signal after resetting.

In the subsequent stages, under the control of the control signals of the first input control terminal MxO and the second input control terminal MxE, the first transistor T1 and the second transistor T2 output the input signals alternately to the first output node Q1 and the second output node Q2, so as to allow the input signals to be split into two sub-signals, and the frequency of the signals of the first output node Q1 and the second output node Q2 are half of the frequency of the input signals, that is, the time length of the cycle of the signals of the first output node Q1 as well as the second output node Q2 are two times as much as the time length of the cycle of the input signal.

For example, by providing the signals at the first output node Q1 and the second output node Q2 to the pixel units of the display panel so as to serve as display data signals, the pixel circuits in the pixel units are compensated or charged in response to the gate scanning signals and according to the display data signals, such that the compensation time of the pixel circuits is allowed to be prolonged to two times as much as the original compensation time, the data voltage can be written more fully, and the display quality can be improved. For example, in the case where the input signal is of 120 Hz, the signals at the first output node Q1 and the second output node Q2 respectively are of 60 Hz. In the case where the frequency of the display data signals is 120 Hz, the compensation time of the conventional pixel circuits is 3.3 μs. The frequency of the display data signals that the pixel unit provides to the signal processing circuit 10 is 60 Hz, and therefore, the compensation time of is 6.5 μs, and the compensation time is prolonged. Of course, embodiments of the present disclosure are not limited to this case, and the input signal (e.g., the display data signal) may be any frequency. For example, the input signal may be of 120 Hz, 90 Hz, 60 Hz or other suitable frequency, so as to adapt to a common screen with a high refresh frequency, AR/VR display, and so on. For example, by matching the frequency of the input signals with the number of the output nodes, the extension value of the compensation time can be adjusted according to demands. For example, in other examples, the frequency of the input signals is 120 Hz, the number of the output nodes is three, and the frequency of the signals at the output nodes is 40 Hz, so as to allow the compensation time to be further prolonged.

Figure 12:
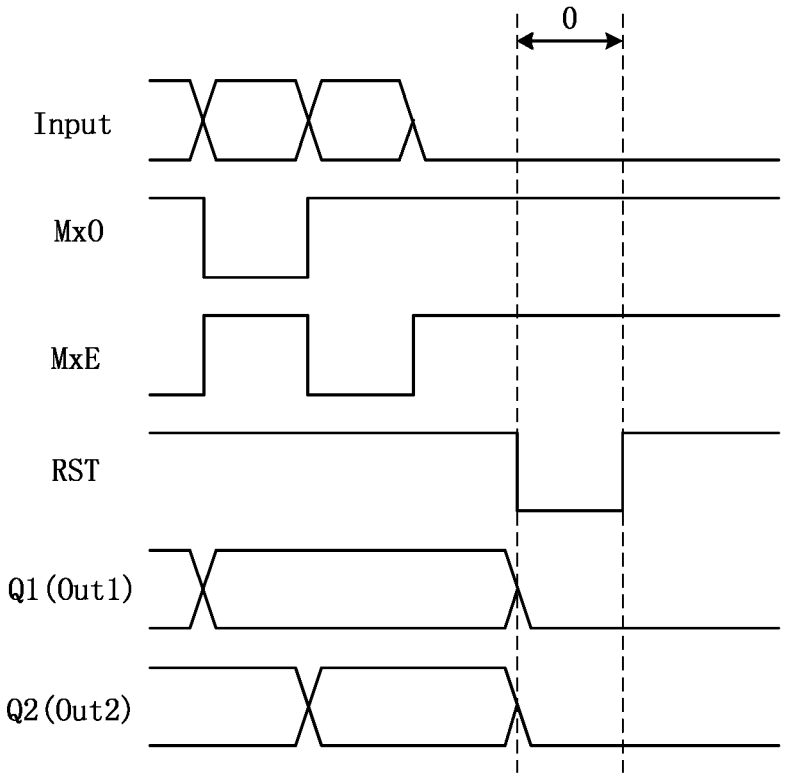
FIG. 12 is a signal timing diagram of another signal processing circuit provided by an embodiment of the present disclosure.

FIG. 12 is a signal timing diagram of another signal processing circuit provided by an embodiment of the present disclosure, the working principle of the signal processing circuit 10 as illustrated FIG. 9 in the reset stage 0 is described in the following with reference to the signal processing circuit as illustrated in FIG. 12.

In the reset stage 0, the reset signal terminal RST provides a low electric level signal, both of the third transistor T3 and the fourth transistor T4 are turned on, so as to allow the first output node Q1 and the second output node Q2 respectively to be electrically connected with the second voltage terminal VSS, such that the first capacitor C1 and the second capacitor C2 are reset, and the signals of the first output node Q1 and the second output node Q2 are low electric levels. For example, both of the first input control terminal MxO and the second input control terminal MxE provide high electric level signals, so as to allow both of the first transistor T1 and the second transistor T2 to be turned off.

For example, reset operation may be performed before scanning each frame of image or after each frame of image is performed, and reset operation may also be performed at a specific time point according to specific demands. Through resetting, the input signals (e.g., display data signals) can be buffered into the first capacitor C1 and the second capacitor C2 with improved accuracy, such that the display quality can be improved.

At least an embodiment of the present disclosure further provides a display panel, which comprises the signal processing circuit according to any embodiment of the present disclosure and a plurality of data lines. N data lines of the plurality of data lines are respectively connected with the N buffer circuits of the signal processing circuit, the input signals are display data signals. The display panel can prolong the compensation time of pixel circuits, be compatible with current pixel circuits and a current drive chip, and the problem of insufficient compensation time for the pixel circuits in a screen with a high refresh frequency can be solved, which is in favor of improving display quality.

Figure 13:
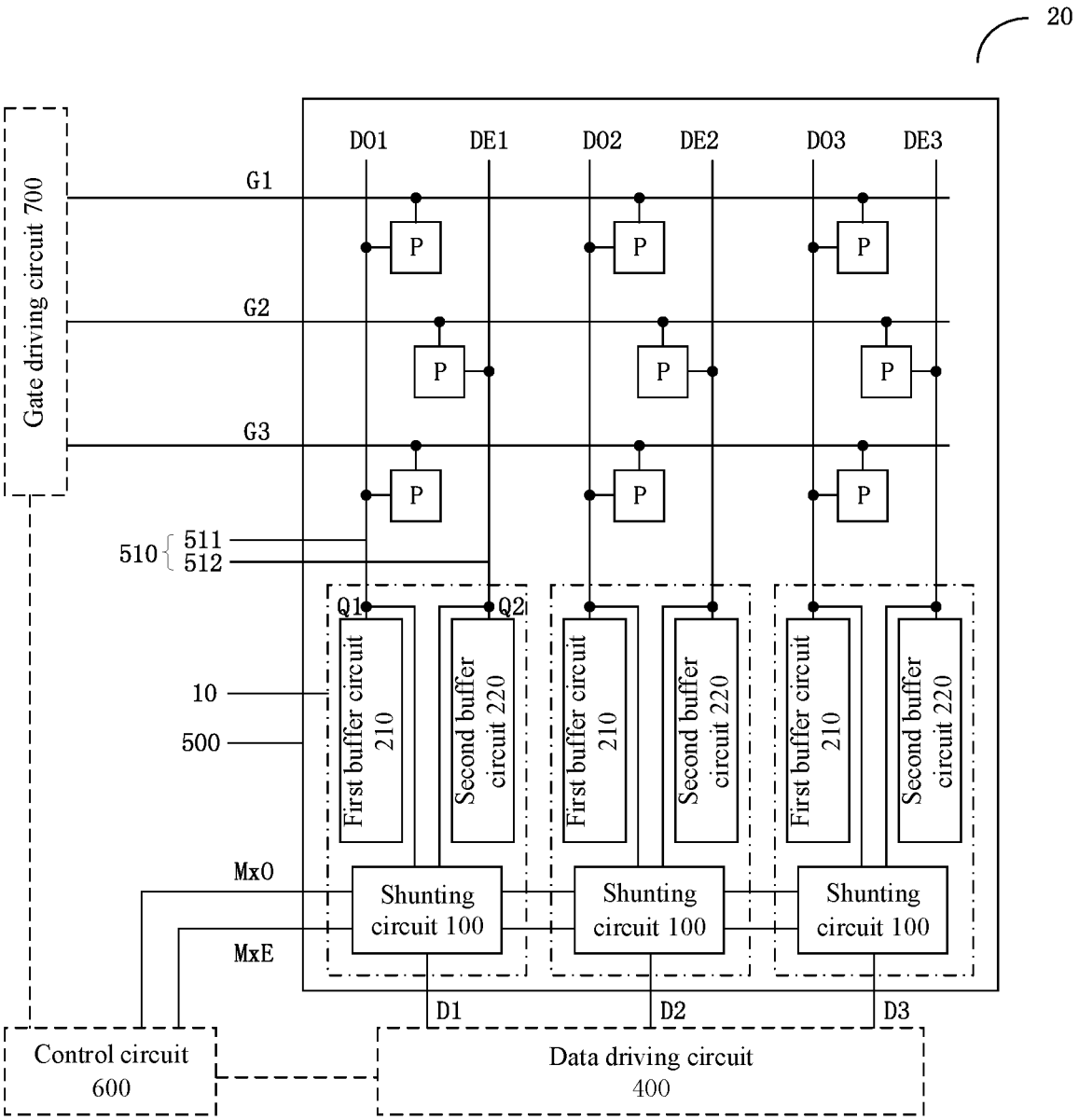
FIG. 13 is a schematic diagram of a display panel provided by an embodiment of the present disclosure.

FIG. 13 is a schematic diagram of a display panel provided by an embodiment of the present disclosure. Referring to FIG. 13, the display panel 20 comprises an array substrate 500, a plurality of signal processing circuits 10, a plurality of data lines 510, and a plurality of pixel units P which are arranged in an array. For example, all of the signal processing circuits 10, the data lines 510 and the pixel units P are arranged on the array substrate 500. The signal processing circuit 10 is the signal processing circuit as described in any embodiment of the present disclosure. For example, the array substrate 500 comprises a display region and a peripheral region, the plurality of pixel units P are provided in the display region, and the plurality of signal processing circuits 10 are provided in the peripheral region. For example, N data lines of the plurality of data lines 510 are respectively connected with the N buffer circuits of each signal processing circuit 10. The N data lines 510 connected with the signal processing circuit 10 are connected with same one column of pixel units P. The same one column of pixel units P comprises N pixel unit groups, and each of the N pixel unit groups are connected with same one data line 510. For example, the pixel units P in the N pixel unit groups are sequentially and alternately arranged along the column direction. For example, the number of the signal processing circuits 10 is equal to the number of the columns of the pixel units P. The number of the data lines 510 is equal to N times as much as the number of the signal processing circuits 10. It should be understood that, same one column of pixel units P refers to the plurality of pixel units that are connected with the same signal processing circuit 10, and is not limited to the case where the centers of the pixel units P in the same column are located on a same line (a virtual line that extends along the column direction). For example, as illustrated in FIG. 13, the centers of the pixel units in different pixel unit groups of same one column of pixel units P may be staggered along the horizontal direction (for example, the lines where the centers of the pixel units in different pixel unit groups of same one column of pixel units P are located are spaced apart from each other). For another example, according to specific implementation demands, the centers of the pixel units P in the same column may also be located on same one line.

In the present embodiment, N is equal to 2, that is, two data lines 510 that are connected with same one signal processing circuit 10 comprise a first data line 511 and a second data line 512. The first data line 511 is connected with the first buffer circuit 210, and the second data line 512 is connected with the second buffer circuit 220. The first data line 511 and the second data line 512 are connected with same one column of pixel units P. The same one column of pixel units P comprises two pixel unit groups, that is, a first pixel unit group and a second pixel unit group. The first pixel unit group comprises the pixel units P located at odd-numbered rows and the second pixel unit group comprises the pixel units P located at even-numbered rows.

For example, the signal processing circuit 10 also is connected with the data driving circuit 400 and the control circuit (for example, a timing controller T-CON) 600 that are provided at the outside of the array substrate 500 through a wire D1 and so on, so as to respectively receive the input signals from the data driving circuit 400 and receive the control signals from the control circuit 600. For example, the above-mentioned input signals are display data signals. The data driving circuit 400 is configured to provide the display data signals to the columns of pixel units P. For example, the data driving circuit 400 may be a drive chip or a data driver. The data driving circuit 400 provides the display data signals that are provided to the columns of pixel units P respectively to the signal processing circuits 10 connected to the columns of pixel units P correspondingly. The control circuit 600 is configured to provide the control signals to the signal processing circuits 10, for example, two control signals are respectively provided to the first input control terminals MxO and the second input control terminals MxE. For example, the first input control terminals MxO of the plurality of signal processing circuits 10 are connected with same one signal line so as to receive same one first control signal, and the second input control terminals MxE of the plurality of signal processing circuits 10 are connected with same one signal line so as to receive same one second control signal. For example, the control circuit 600 may also be provided on the array substrate 500, or be integrated in the data driving circuit 400.

For example, the number of the output terminals of the data driving circuit 400 may be equal to the number of the signal processing circuits 10 and equal to the number of the columns of the pixel units P, that is, the number of the output terminals of the data driving circuit 400 of the display panel provided by embodiments of the present disclosure remains unchanged as compared to the number of the terminals of the data driver circuit of a conventional display panel, and therefore, the display panel provided by embodiments of the present disclosure may adopt a current data driver circuit (e.g., drive chip), such that the design costs and the manufacturing costs of the display panel can be reduced.

It should be understood that, according to specific implementation demands, the signal processing circuits 10 may also be provided at the outside of the array substrate 500, the signal processing circuits 10, for example, may be integrated into the data driving circuit 400, so as to increase the number of the output terminals of the data driving circuit 400.

For example, the N data lines 510 connected with same one signal processing circuit 10 are located at different layers of the array substrate 500. In the present embodiment, N is equal to 2, that is, the first data line 511 and the second data line 512 are located in different layers of the array substrate 500. Through this arrangement, the signal interference between the data lines can be decreased, while the difficulty of fabricating the array substrate is not increased, which is in favor of increasing pixels per inch (PPI). For example, in one example, the first data line 511 is formed in the data line layer of the conventional array substrate, then an insulation layer and a metal layer are additionally formed, and the second data line 512 is formed from the metal layer. This method can effectively reduce the signal interference between the first data line 511 and the second data line 512, while the manufacturing processes for the original data line layer is not affected.

It should be understood that, in embodiments of the present disclosure, the position relationship between the N data lines 510 are not limited, the N data lines 510 may be in different layers, or, part of the data lines 510 of the N data lines 510 may be in different layers. The relationship, in stacking order, between the N data lines 510 is not limited, and may be set according to actual wire arrangements of the display panel. Of course, the N data lines 510 may also be provided in the same layer provided that the manufacturing conditions allow, such that the manufacturing processes can be simplified and the panel thickness can be reduced.

For example, the display panel 20 further comprises a gate driving circuit 700, and the plurality of pixel units P are connected with the gate driving circuit 700. The gate driving circuit 700 is configured to provide a plurality of gate scanning signals so as to scan the pixel units P of the display panel 20. The number of the gate driving circuit 700 is not limited, and may be set according to specific implementation requirements. For example, in other examples, the display panel 20 comprises two gate driving circuits 700 that are respectively provided at two sides of the display panel 20, so as to realize double-side driving. For example, the gate driving circuit 700 that is provided at one side of the display panel 20 is configured to drive gate lines at odd-numbered rows, and the gate driving circuit 700 that is provided at the other side of the display panel 20 is configured to drive gate lines at even-numbered rows.

It should be understood that, in embodiments of the present disclosure, the arrangement of the gate driving circuit 700 is not limited, and may be set according to specific implementation requirements. For example, the gate driving circuit 700 may be a gate driver provided at the outside of the array substrate 500. For example, the gate driving circuit 700 may also be provided on the array substrate 500, so as to form a GOA (Gate-driver On Array) circuit, such that the number of wires for connecting the display panel 20 with other components can be reduced.

For example, for enabling the display data signals outputted by the first buffer circuit 210 and the second buffer circuit 220 to cooperate, the pulse durations (i.e., the pulse time period) of the gate scanning signals for adjacent rows partially overlap, that is, the pulse duration of the gate scanning signal for the (M+1)th row and the pulse duration of the gate scanning signal for the (M)th row partially overlap, and M is an integer larger than zero.

For example, the pixel unit P comprises a pixel circuit, and the pixel circuit for example may be implemented as a 7T1C type pixel circuit as illustrated in FIG. 15A, a 6T1C type pixel circuit, a 5T2C type pixel circuit, or other pixel circuit with a threshold compensation function. For example, the gating control terminals GAT of the pixel circuits as illustrated in FIG. 15A may be connected with the gate driving circuit 700 via gate lines, the data signal receiving terminals DAT of the pixel circuits may be connected with the signal processing circuits 10 and the data driving circuit 400 via data lines.

Figure 14:
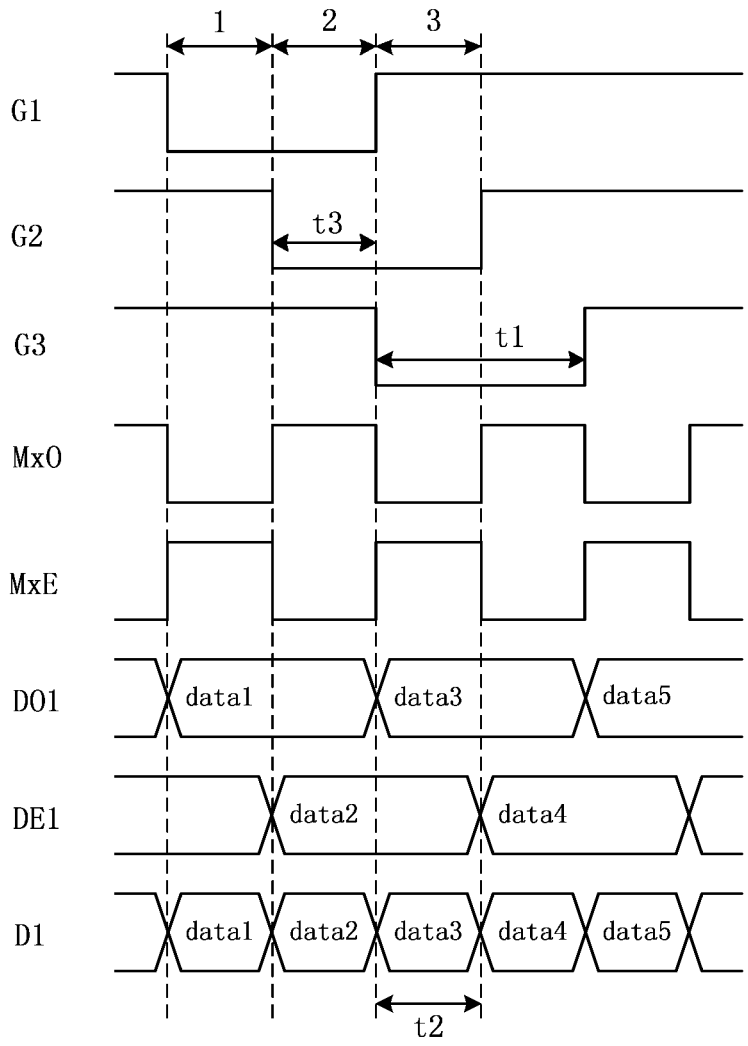
FIG. 14 is a signal timing diagram of a display panel provided by an embodiment of the present disclosure.

FIG. 14 is a signal timing diagram of a display panel provided by an embodiment of the present disclosure. The working principle of the display panel 20 as illustrated in FIG. 13 is described in the following with reference to the signal timing diagram as illustrated in FIG. 14. The working principle of the signal processing circuit 10 of the display panel 20 is similar with the working principle of the signal processing circuit 10 as illustrated in FIG. 7, and no further description will be given here.

During the first stage 1 and the second stage 2, the signal processing circuit 10 outputs the display data signals originated from the data driving circuit 400 respectively to the first output node Q1 and the second output node Q2 under the control of the control signals, the first buffer circuit 210 and the second buffer circuit 220 respectively buffer and output the display data signals received from the wire D1 to the first data line 511 (DO1) and the second data line 512 (DE1). The first data line 511 provides the signal at the first output node Q1 to the first pixel unit group (the pixel units P located at odd-numbered rows), and the second data line 512 provides the signal at the second output node Q2 to the second pixel unit group (the pixel units P located at even-numbered rows). During subsequent stages, the display data signals are alternately provided to the first pixel unit group and the second pixel unit group according to the above-mentioned methods.

The gate driving circuit 700 provides a plurality of gate scanning signals (G1, G2, G3, and so on), so as to scan the plurality of pixel units P. During the first stage 1 and the second stage 2, the first row of the gate scanning signal G1 (e.g., the gate scanning signal provided to the first row of the pixel units) is at a low electric level, so as to allow the first row of the pixel units P to be turned on, such that compensation or charging can be performed under the action of the display data signal provided by the first data line 511 (DO1). During the second stage 2 and the third stage 3, the second row of the gate scanning signal G2 (e.g., the gate scanning signal provided to the second row of the pixel units) is at a low electric level, so as to allow the second row of the pixel units P to be turned on, such that compensation or charging can be performed under the action of the display data signal provided by the second data line 512 (DE1). During subsequent stages, compensation or charging can be respectively performed with respect to the pixel units P located at odd-numbered rows and the pixel units P located at even-numbered rows according to the above-mentioned methods.

For example, in the present example, the pulse duration t1 of the gate scanning signals is equal to two times as much as the cycle t2 of the display data signals, so as to prolong the compensation time or the charging time as much as possible. For example, the pulse duration of the gate scanning signal for (M+1)th row and the pulse duration of the gate scanning signal for (M)th row partially overlap, and the overlapping time is t3. For example, the overlapping time t3 is equal to the cycle t2 of the display data signal, that is, the overlapping time t3 is equal to ½ of the pulse duration t1. By this way, the compensation time of the pixel circuits of the pixel units P is prolonged to two times as much as the original compensation time. For example, in other examples, in the case where same one column of pixel units P comprises N pixel unit groups, the overlapping time t3 is (N−1)/N times as much as the pulse duration t1, so as to allow the compensation time of the pixel circuits of the pixel units P is prolonged to N times of the original compensation time. The above-mentioned method allows the data voltages to be written more fully and allows the display quality to be improved.

For example, the pulse duration of the gate scanning signals is equal to N times of the cycle of the display data signals provided by the data driving circuit 400; because of the signal buffer function of the buffer circuits, the pixel units can continuously receive the display data signals during the pulse duration of the gate scanning signals, that is, the compensation time that can be used for each pixel unit is N times of the cycle of the display data signals, such that the compensation effect of the pixel circuits of the pixel units P can be improved, and the brightness uniformity of the display panel can be improved. At least an embodiment of the present disclosure further provides a display device, which comprises a signal processing circuit 10 provided by any embodiment of the present disclosure or a display panel 20 provided by any embodiment of the present disclosure. The display device can prolong the compensation time of the pixel circuits, be compatible with a current pixel circuit and a current drive chip, and the problem of insufficient compensation time for the pixel circuits in the screen with high refresh frequency can be solved, which is in favor of improving display quality.

For example, the display device may be any products or device that has display function, such as a liquid crystal panel, a liquid crystal television, a display, an OLED panel, an OLED television, an electronic paper display device, a cell phone, a tablet computer, a laptop, a digital photo frame and a navigator, and no specific limitation will be given in embodiments of the present disclosure in this respect. The technical effect of the display device may refer to related descriptions, as described in the above-mentioned embodiments, of the signal processing circuit 10 and the display panel 20, and no further description will be given here.

At least an embodiment of the present disclosure also provides a driving method of a signal processing circuit, which may be used in driving a signal processing circuit 10 provided by any embodiment of the present disclosure. By adopting the driving method, the compensation time of the pixel circuits can be prolonged, a current pixel circuit and a current drive chip can be adopted, the problem of insufficient compensation time for the pixel circuits in the screen with high refresh frequency can be solved, which is in favor of improving display quality.

For example, in one example, the driving method of the signal processing circuit comprises the following operations: providing control signals and input signals; allowing the shunting circuit 100 to sequentially output the input signals to the N output nodes respectively at N different time points in response to the control signals; buffering and outputting the input signals through buffer circuits 200, in which N is an integer great than or equal to 2.

At least an embodiment of the present disclosure also provides a driving method of a display panel, which may be used to drive the display panel 20 provided by any embodiment of the present disclosure. By adopting the driving method, the compensation time of the pixel circuits can be prolonged, a current pixel circuit and a current drive chip can be adopted, the problem of insufficient compensation time for the pixel circuits in the screen with high refresh frequency can be solved, and this is in favor of improving display quality.

For example, in one example, the driving method of the display panel comprises the following operations: providing control signals and display data signals; allowing the shunting circuit 100 to sequentially output the display data signals to the N output nodes respectively at N different time points in response to the control signals; and buffering and outputting the display data signals to corresponding N data lines through corresponding buffer circuits 200, in which N is an integer great than or equal to 2.

For example, the driving method of the display panel further comprises: providing gate scanning signals, so as to perform row scanning with respect to the display panel 20, and the pulse durations of gate scanning signals which are adjacent to each other partially overlap.

It should be understood that, the detailed descriptions and the technical effect regarding the driving method of the signal processing circuit and the driving method of the display panel may refer to the descriptions of the working principles of the signal processing circuit 10 and the display panel 20 provided by embodiments of the present disclosure, and no further description will be given here.

The following statements should be noted:

(1) The accompanying drawings involve only the structure(s) in connection with the embodiment(s) of the present disclosure, and other structure(s) can be referred to common design(s).

(2) In case of no conflict, features in one embodiment or in different embodiments can be combined.

What are described above is related to the illustrative embodiments of the disclosure only and not limitative to the scope of the disclosure; the scopes of the disclosure are defined by the accompanying claims.

What is claimed is:

1. A display panel, comprising a signal processing circuit and a plurality of data lines, wherein the signal processing circuit comprises a shunting circuit and N buffer circuits;

the shunting circuit comprises N output nodes;

the N buffer circuits are respectively connected with the N output nodes;

the shunting circuit is configured to output input signals to the N output nodes respectively at N different time points in response to control signals;

each of the N buffer circuits is configured to buffer an input signal received by an output node corresponding to the each of the N buffer circuits;

N data lines of the plurality of data lines are respectively connected with the N buffer circuits of the signal processing circuit, and the input signals are display data signals;

a first terminal of the each of the N buffer circuits is configured to be connected with the output node corresponding to the each of the N buffer circuits; and a second terminal of the each of the N buffer circuits is configured to be connected with a first voltage terminal, so as to receive a first voltage.

2. The display panel according to claim 1, wherein the each of the N buffer circuits comprises a capacitor, a first electrode of the capacitor serves as the first terminal of the each of the N buffer circuits, and a second electrode of the capacitor serves as the second terminal of the each of the N buffer circuits.

3. The display panel according to claim 1, wherein the signal processing circuit further comprises N reset circuits, and the N reset circuits are respectively connected with the N output nodes and are configured to reset the N output nodes in response to a reset signal.

4. The display panel according to claim 3, wherein a control terminal of each of the N reset circuits is configured to be connected with a reset signal line so as to receive the reset signal, a first terminal of the each of the N reset circuits is configured to be connected with an output node corresponding to the each of the N reset circuits, and a second terminal of the each of the N reset circuits is configured to be connected with a second voltage terminal so as to receive a second voltage.

5. The display panel according to claim 4, wherein the each of the N reset circuits comprises a reset transistor, a gate electrode of the reset transistor serves as the control terminal of the each of the N reset circuits, a first terminal of the reset transistor serves as the first terminal of the each of the N reset circuits, and a second terminal of the reset transistor serves as the second terminal of the each of the N reset circuits.

6. The display panel according to claim 1, wherein the shunting circuit further comprises an input terminal, N input control terminals and N switching circuits;

the N switching circuits are connected with the input terminal, respectively connected with the N output nodes in one-to-one correspondence, and respectively connected with the N input control terminals in one-to-one correspondence;

each of the N switching circuits is configured to output an input signal received from the input terminal to an output node corresponding to the each of the N switching circuits in response to one of the control signals received from an input control terminal corresponding to the each of the N switching circuits.

7. The display panel according to claim 6, wherein the each of the N switching circuits comprises a switching transistor, a gate electrode of the switching transistor is connected with the input control terminal corresponding to the each of the N switching circuits, a first terminal of the switching transistor is connected with the input terminal, and a second terminal of the switching transistor is connected with the output node corresponding to the each of the N switching circuits.

8. The display panel according to claim 6, wherein N is equal to 2, and the N input control terminals are connected with each other, so as to be connected with same one input control line.

9. The display panel according to claim 8, wherein the N switching circuits comprises a first switching circuit and a second switching circuit;

the shunting circuit further comprises an invert circuit; and one of the first switching circuit and the second switching circuit is connected with the N input control terminals through the invert circuit.

10. The display panel according to claim 1, further comprising a plurality of pixel units which are arranged in an array, wherein the N data lines which are connected to the signal processing circuit are connected with same one column of pixel units;

the same one column of pixel units comprises N pixel unit groups; and each of the N pixel unit groups is connected with same one data line of the N data lines.

11. The display panel according to claim 10, wherein N is equal to 2;

the N pixel unit groups comprise a first pixel unit group and a second pixel unit group;

the first pixel unit group comprises pixel units at odd numbered rows, and the second pixel unit group comprises pixel units at even numbered rows.

12. The display panel according to claim 10, further comprising an array substrate, wherein the signal processing circuit is on the array substrate.

13. The display panel according to claim 12, wherein the N data lines which are connected to same one signal processing circuit are in different layers of the array substrate.

14. The display panel according to claim 10, further comprising at least one gate driving circuit, wherein the gate driving circuit is configured to provide a plurality of gate scanning signals, so as to scan the pixel units of the display panel; and a pulse duration of a gate scanning signal for (M+1)th row partially overlaps a pulse duration of a gate scanning signal for (M)th row, and M is an integer greater than 0.

15. A signal processing circuit, comprising:

a shunting circuit which comprises N output nodes;

N buffer circuits which are respectively connected with the N output nodes, wherein the shunting circuit is configured to output input signals to the N output nodes respectively at N different time points in response to control signals;

each of the N buffer circuits is configured to buffer an input signal received by an output node corresponding to the each of the N buffer circuits;

a first terminal of the each of the N buffer circuits is configured to be connected with the output node corresponding to the each of the N buffer circuits; and a second terminal of the each of the N buffer circuits is configured to be connected with a first voltage terminal, so as to receive a first voltage;

N is an integer that is greater than or equal to 2.

16. A display device, comprising the display panel according to claim 1.

17. A driving method of a display panel, wherein the display panel comprises a signal processing circuit and a plurality of data lines, and wherein the signal processing circuit comprises a shunting circuit and N buffer circuits; the shunting circuit comprises N output nodes; the N buffer circuits are respectively connected with the N output nodes; the shunting circuit is configured to output input signals to the N output nodes respectively at N different time points in response to control signals; each of the N buffer circuits is configured to buffer an input signal received by an output node corresponding to the each of the N buffer circuits; N data lines of the plurality of data lines are respectively connected with the N buffer circuits of the signal processing circuit, and the input signals are display data signals; a first terminal of the each of the N buffer circuits is configured to be connected with the output node corresponding to the each of the N buffer circuits; and a second terminal of the each of the N buffer circuits is configured to be connected with a first voltage terminal, so as to receive a first voltage, comprising:

providing the control signals and the display data signals;

allowing the shunting circuit to sequentially output the display data signals to the N output nodes respectively at the N different time points in response to the control signals; and buffering and outputting the display data signals to N corresponding data lines through the N buffer circuits.

18. The driving method according to claim 17, further comprising:

providing gate scanning signals, so as to perform row scanning with respect to the display panel, wherein pulse durations of gate scanning signals which are adjacent to each other partially overlap.

* * * * *